US008458883B2

(12) United States Patent
Uchiumi et al.

(10) Patent No.: US 8,458,883 B2
(45) Date of Patent: Jun. 11, 2013

(54) METHOD OF ASSEMBLING INNER DIAMETER GRINDING TOOL

(75) Inventors: Satoru Uchiumi, Tochigi (JP); Takashi Yoshida, Tochigi (JP); Koji Saito, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 592 days.

(21) Appl. No.: 12/749,764

(22) Filed: Mar. 30, 2010

(65) Prior Publication Data

US 2010/0251623 A1 Oct. 7, 2010

(30) Foreign Application Priority Data

Mar. 31, 2009 (JP) ..... 2009-085449

(51) Int. Cl.
*B21D 39/00* (2006.01)

(52) U.S. Cl.
USPC ..... 29/455.1; 29/525.01; 29/525.11; 51/293

(58) Field of Classification Search
USPC ..... 279/133; 29/455.1, 525.01, 525.11; 451/463–487, 540; 51/293
See application file for complete search history.

(56) References Cited

U.S. PATENT DOCUMENTS 1,902,176 A * 3/1933 Miner ..... 82/169
2,330,184 A * 9/1943 Hause ..... 451/478
2,694,885 A * 11/1954 Peden ..... 451/464
2,788,621 A * 4/1957 Doyle ..... 451/485
3,507,077 A * 4/1970 Magsig ..... 451/470
3,561,172 A * 2/1971 Werner ..... 451/464
3,712,632 A * 1/1973 Wightman et al. ..... 279/62
3,861,091 A * 1/1975 McDonald ..... 451/476
3,987,591 A * 10/1976 Czubak ..... 451/478
4,065,881 A * 1/1978 Gillette ..... 451/476
4,434,588 A * 3/1984 Wada et al. ..... 451/476
5,105,523 A * 4/1992 Howard ..... 29/467
5,674,121 A * 10/1997 Carr et al. ..... 451/466
6,830,502 B2 * 12/2004 Buettiker et al. ..... 451/41

FOREIGN PATENT DOCUMENTS

JP 2003165021 A * 6/2003
SU 1014695 A * 4/1983

* cited by examiner

*Primary Examiner* — David Bryant
*Assistant Examiner* — Jacob Cigna
(74) *Attorney, Agent, or Firm* — Rankin, Hill & Clark LLP

(57) ABSTRACT

A tool for grinding an inner diameter even when holders having grindstones are axially connected. A gap enclosed by the inner peripheral surface of a divided tool holder, a draw bar and O-rings is formed in a state in which the draw bar is inserted into a tool holder in which a plurality of divided tool holders are connected in series. A filler is filled into the gap to fix a support bush to the divided tool holder. An adjustment screw of each arm held circumferentially away from each other on the divided tool holder is turned to adjust a distance between a pin and the arm, and the radial projecting amount of each of grindstones is adjusted. The projecting amount is adjusted such that the plurality of grindstones rotate along the same rotational trajectory and the center of the rotational trajectory corresponds to the axis of the draw bar.

6 Claims, 5 Drawing Sheets

(a)

(b)

METHOD OF ASSEMBLING INNER DIAMETER GRINDING TOOL

BACKGROUND OF THE INVENTION

1. Field of the Invention

The present invention relates to a method of assembling an inner diameter grinding tool which precisely grinds the inner surface of a hole formed in a workpiece by a drill or the like.

2. Description of the Related Art

As a tool for grinding the inner diameter of a crank journal bearing that is formed by combining a cylinder block and a lower block, a tool having a roughing cutter, a semi-finishing cutter, and a finishing cutter provided axially in series and on the same axis line has been proposed in Japanese Patent Laid-Open No. 2007-090450.

In the tool disclosed in Japanese Patent Laid-Open No. 2007-090450, the projecting amount of the cutter in the radial direction of the tool cannot be adjusted. Thus, when a plurality of portions to be machined are ground at the same time, the tool body (an arbor) interferes with a workpiece. To solve the problem, a machining tool where the radial projecting amount of a cutter can be adjusted has been proposed in Japanese Patent Laid-Open Nos. 2003-165021 and 2005-14175.

Japanese Patent Laid-Open No. 2003-165021 discloses a reamer in which a plurality of rectangular concave portions are formed in the outer periphery of a holder, a blade (a grindstone) is housed in each of the concave portions, a slider having a conical portion is provided in the hollow cylinder of the holder, and the slider is moved to adjust the radial length of the blade, as a conventional example.

Japanese Patent Laid-Open No. 2003-165021 also discloses a structure in which a slit is provided at a position close to the outer peripheral surface of the blade between both the ends in the longitudinal direction thereof, a rectangular through hole is formed perpendicular to and including the slit, and a shim is inserted into the through hole, to thereby finely adjust the radial length independently with respect to each of the blades, as an improved example of the conventional example.

Furthermore, Japanese Patent Laid-Open No. 2005-14175 discloses a structure as below. An abrasive grain portion is formed on the outer peripheral surface of a cylindrical portion of a grindstone body by fixing abrasive grains thereon. A chamfered corner portion inclined toward the edge such that the diameter becomes smaller, and a machining dimension finishing portion are formed at an end portion of the abrasive grain portion. The end portion of the abrasive grain portion is also cut in a staggered shape with a first slit and a second slit extending in the axial direction, to form a parallel expansion portion on the abrasive grain portion. A tapered hole is formed in the inner peripheral surface of the cylindrical portion over the entire length of the parallel expansion portion of the abrasive grain portion. A tapered cone is fitted into the tapered hole. By axially adjusting the position of the tapered cone, the parallel expansion portion of the abrasive grain portion is parallelly expanded.

When a tool not capable of extending the radial length of a grinding section machines a workpiece having a plurality of portions to be machined such as a crank journal bearing at the same time, the tool interferes with the workpiece.

Even if a tool capable of extending the radial length of a grinding section is used, the center of a draw bar is misaligned from the center of a tool holder in the vicinity of a distal end portion as shown in FIGS. 7(A) and 7(B) when the axial length of the grinding section is extended, the axial length of the tool holder holding the grinding section is thus extended, and the draw bar inserted into the tool holder is also lengthened. As a result, only a specific grinding section out of a plurality of grinding sections grinds the workpiece, thereby causing uneven wearing, or deterioration in surface accuracy and machining accuracy with the draw bar moving erratically in the tool holder during rotation.

To solve the problem, the tool holder includes a plurality of axially divided tool holders, so that each of the divided tool holders is relatively easily aligned with the center of the tool holder. However, it becomes difficult to accurately obtain the coaxiality of the inner diameter of the tool holder at the time of assembling the divided tool holders.

SUMMARY OF THE INVENTION

To solve the aforementioned problems, a method of assembling an inner diameter grinding tool according to the present invention, including the steps of: fitting a support bush onto a draw bar or fitting the support bush into a cylindrical tool holder via an O-ring as step 1; inserting the draw bar, onto which the support bush is fitted, into the tool holder or inserting the draw bar into the tool holder, into which the support bush is fitted, as step 2; fixing the support bush to the tool holder by fixing means such that a gap formed between an inner peripheral surface of the tool holder and an outer peripheral surface of the support bush is not changed as step 3; and adjusting a projecting amount of each grinding section such that a plurality of grinding sections held circumferentially away from each other on the tool holder rotate along a same rotational trajectory and a center of the rotational trajectory corresponds to an axis of the draw bar as step 4.

When a workpiece having a plurality of portions to be machined is machined, the tool holder is preferably axially divided into a plurality of divided tool holders. In this case, the support bush is fixed to each of the divided tool holders.

As the fixing means, the support bush may be fixed to the tool holder by feeding a filler into the gap between the inner peripheral surface of the tool holder or the divided tool holder and the outer peripheral surface of the support bush in a state in which the draw bar is inserted into the tool holder or the divided tool holder.

As another fixing means, the support bush may be fixed to the tool holder at three points in a circumferential direction, for example, from outside by using a threaded member such as a screw in a state in which the draw bar is inserted into the tool holder or the divided tool holder.

In the inner diameter grinding tool according to the present invention, the tool holder has a fixed positional relationship with the draw bar via the support bush. The radial projecting amount of each of the grinding sections (grindstones) is separately adjusted based on the fixed positional relationship. Thus, even if the center of the tool holder is misaligned from the center of the draw bar, the misalignment between the center of the tool holder and the center of the draw bar can be canceled by aligning the rotational center of each of the plurality of grinding sections with the center of the draw bar.

Therefore, even when the plurality of holders having the grinding sections are axially connected, the inner diameter can be accurately and effectively ground at a plurality of positions at the same time since the misalignment from the center of the draw bar can be canceled with respect to each of the tool holders.

DETAILED DESCRIPTION OF THE PREFERRED EMBODIMENTS

Figure 1:
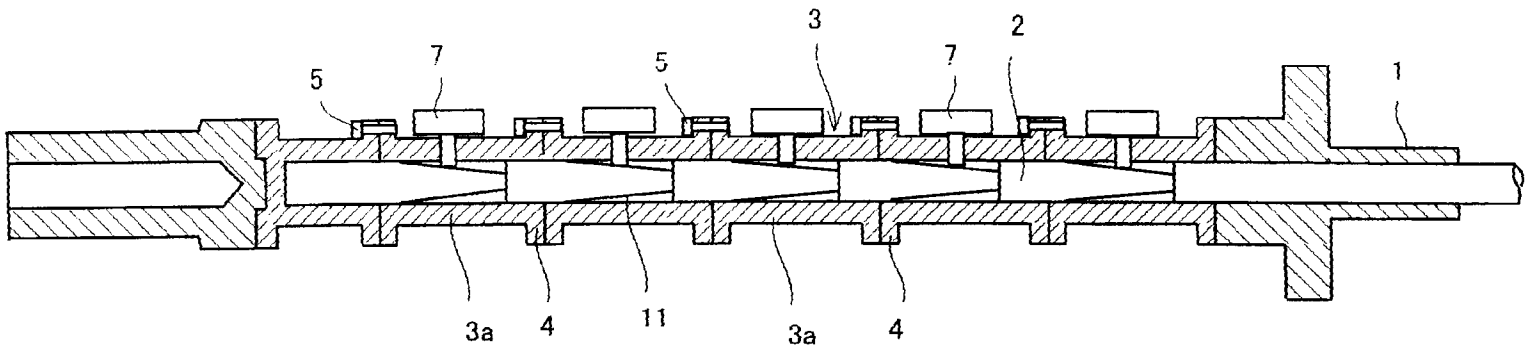
FIG. 1 is an entire sectional view of an inner diameter grinding tool assembled using a method according to the present invention.
Figure 2:
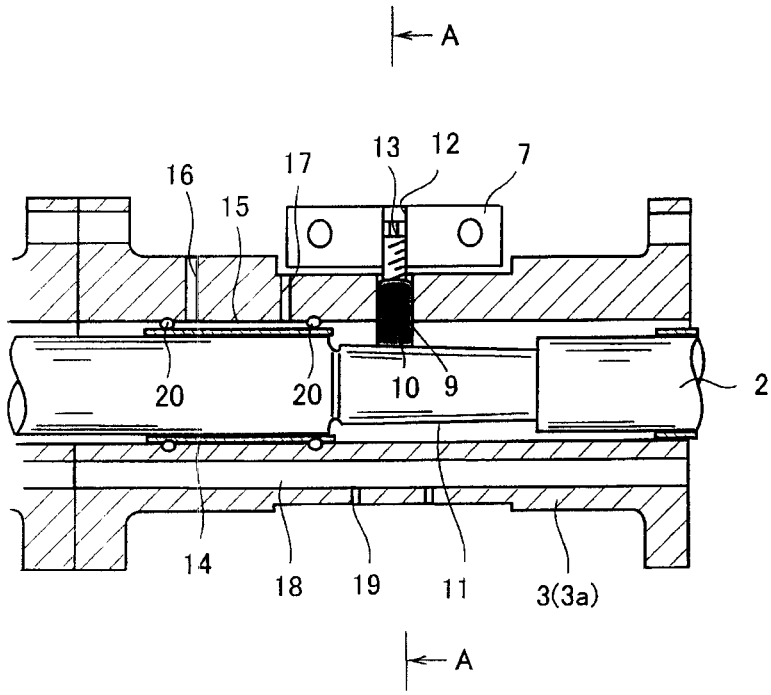
FIG. 2 is a main portion enlarged view of FIG. 1.
Figure 3:
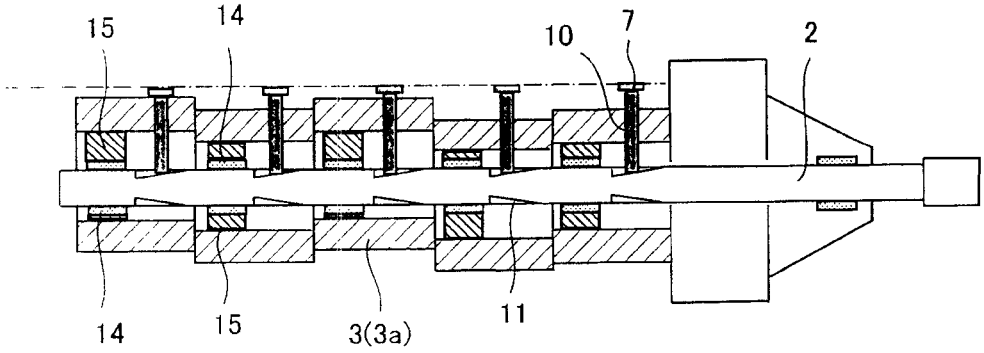
FIG. 3 is a view similar to FIG. 2 exaggeratedly showing eccentricity between a tool holder and a draw bar.
Figure 4:
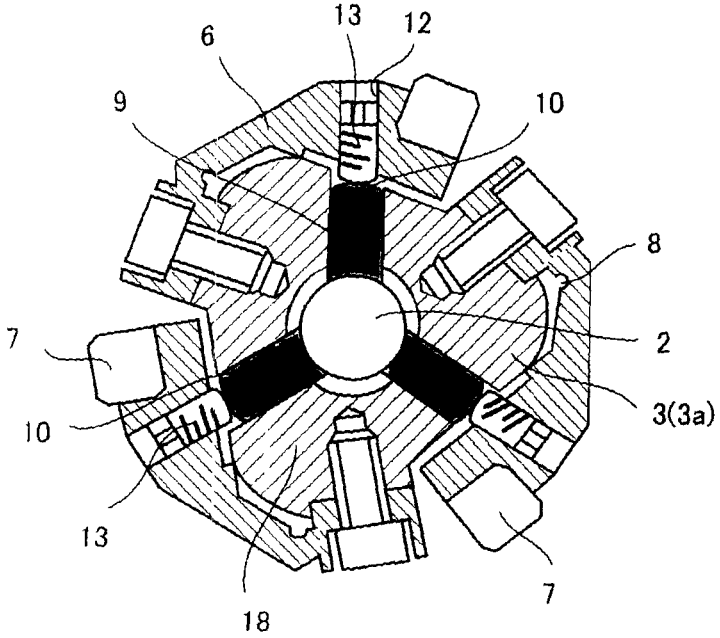
FIG. 4 is a sectional view taken in the direction of A-A in FIG. 2.
Figure 5:
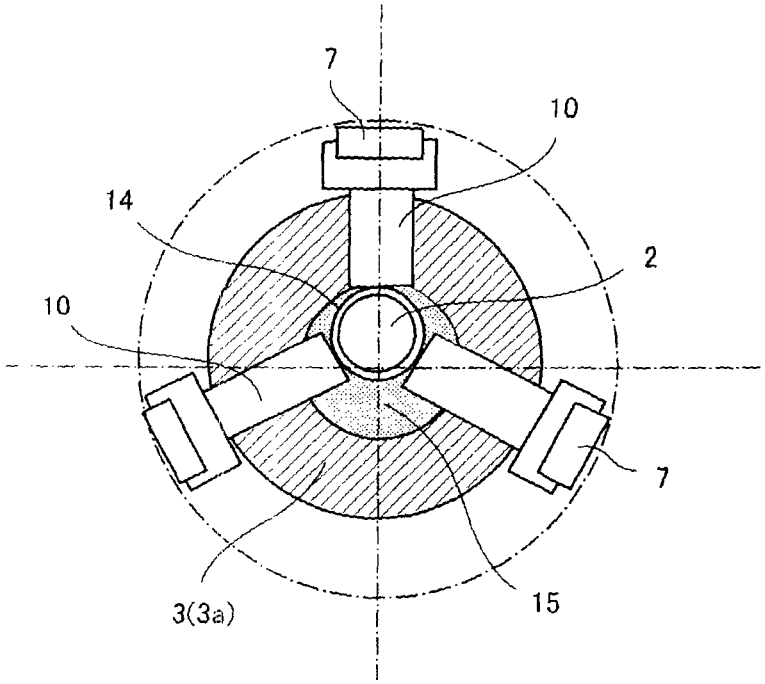
FIG. 5 is a view similar to FIG. 4 exaggeratedly showing the eccentricity between the tool holder and the draw bar.

In the following, preferred embodiments will be described based on the accompanying drawings. FIG. 1 is an entire sectional view of an inner diameter grinding tool assembled using a method according to the present invention. FIG. 2 is a main portion enlarged view of FIG. 1. FIG. 3 is a view similar to FIG. 2 exaggeratedly showing the eccentricity between a tool holder and a draw bar. FIG. 4 is a sectional view taken in the direction of A-A in FIG. 2. FIG. 5 is a view similar to FIG. 4 exaggeratedly showing the eccentricity between the tool holder and the draw bar.

In the inner diameter grinding tool, one end of a tool holder 3 into which a draw bar 2 is inserted is mounted on a main shaft 1 that is rotated by a spindle. The draw bar 2 can move axially forward and backward by a cylinder unit or a motor. The tool holder 3 includes a plurality of divided tool holders 3*a*. Flange portions 4 are provided at both the ends of each of the divided tool holders 3*a*. The flange portions 4 of the divided tool holders 3*a* are brought into abutment against each other and coupled together by a bolt 5.

Each of the divided tool holders 3*a* includes three metal arms 6 circumferentially spaced apart from each other at equal intervals. Each of the arms 6 is formed to enclose a portion of the divided tool holder 3*a* in the circumferential direction. A grindstone 7 as a grinding section is replaceably mounted on the distal end of each of the arms 6. Diamond abrasive grains or CBN abrasive grains are fixed on the surface of the grindstone 7 by electrodeposition. Alternatively, a cutting tool other than the grindstone may be also mounted on the arm 6.

A groove portion 8 is formed in the width direction in a portion close to the proximal end of each of the arms 6. The groove portion 8 is parallel to the axis of the divided tool holder 3*a* in a state in which the arm 6 is mounted on the divided tool holder 3*a*. When an external force is applied to the arm 6, the arm 6 acts as an elastic hinge, to increase or decrease in diameter, and also to abut against a ground surface formed on a workpiece with a constant force at all times.

Through holes 9 are radially formed in each of the divided tool holders 3*a*. A pin 10 is housed in each of the through holes 9. The inner side end of the pin 10 abuts against a tapered portion 11 of the draw bar 2. The tapered portion 11 of the draw bar 2 is formed corresponding to each of the divided tool holders 3*a*.

Meanwhile, a threaded hole 12 is formed through a portion close to the distal end of each of the arms 6 in the thickness direction. An adjustment screw 13 is inserted into the threaded hole 12, and the inner side end of the adjustment screw 13 abuts against the outer side end of the pin 10.

The arm 6 revolves around the groove portion 8 by turning the adjustment screw 13 and thereby adjusting a distance between the pin 10 and the arm 6. Accordingly, the radial projecting amount of each of the grindstones 7 can be adjusted. Since the adjustment screw 13 is exposed on the outer peripheral surface of the tool, the adjusting operation can be easily performed.

Meanwhile, a support bush 14 in sliding contact with the outer peripheral surface of the draw bar 2 (a portion other than the tapered portion 11) is fixed to the inner peripheral surface of each of the divided tool holders 3*a*. A minute gap exists between the outer peripheral surface of the support bush 14 and the inner peripheral surface of the divided tool holder 3*a*. A filler 15 such as resin is filled in the gap, so that the support bush 14 is fixed to the divided tool holder 3*a*.

An injection port 16 for feeding the filler 15 such as resin into the gap and an air vent 17 for removing air at the time of injection are formed in each of the divided tool holders 3*a*. An axial coolant supply path 18 and a coolant ejection port 19 are also formed in each of the divided tool holders 3*a*.

With the above configuration, the inner diameter grinding tool is assembled following the next procedure.

First, the support bush 14 is fitted onto a predetermined portion of the draw bar 2, or is fitted into a predetermined portion of the divided tool holder 3*a* via O-rings.

Subsequently, the draw bar 2 is inserted into the tool holder 3 where the plurality of divided tool holders 3*a* are connected in series. FIGS. 3 and 5 exaggeratedly show a state in which the axis of each of the divided tool holders 3*a* is largely misaligned for ease of explanation. In the actual inner diameter grinding tool, however, the misalignment is small enough not to be visually recognized. However, the misalignment becomes to an issue in a case of precise grinding.

A gap enclosed by the inner peripheral surface of the divided tool holder 3*a*, the draw bar 2 and O-rings 20 and 20 is formed in a state in which the draw bar 2 is inserted into the divided tool holder 3*a* (the tool holder 3). The gap includes a wide portion and a narrow portion due to the misalignment between the axis of the draw bar 2 and the axis of the divided tool holder 3*a*.

Thereafter, the filler 15 such as resin is injected into the gap from the injection port 16, to thereby fix the support bush 14 to the divided tool holder 3*a*. At this point, the support bush 14 is fixed to the divided tool holder 3*a* with their axes being misaligned from each other.

The adjustment screw 13 of each of the arms 6 held circumferentially away from each other on the divided tool holder 3*a* is turned to adjust the distance between the pin 10 and the arm 6, so that the radial projecting amount of each of the grindstones 7 is adjusted. The projecting amount is adjusted such that the plurality of (three in the drawings) grindstones 7 rotate along the same rotational trajectory and the center of the rotational trajectory corresponds to the axis of the draw bar.

Figure 6:
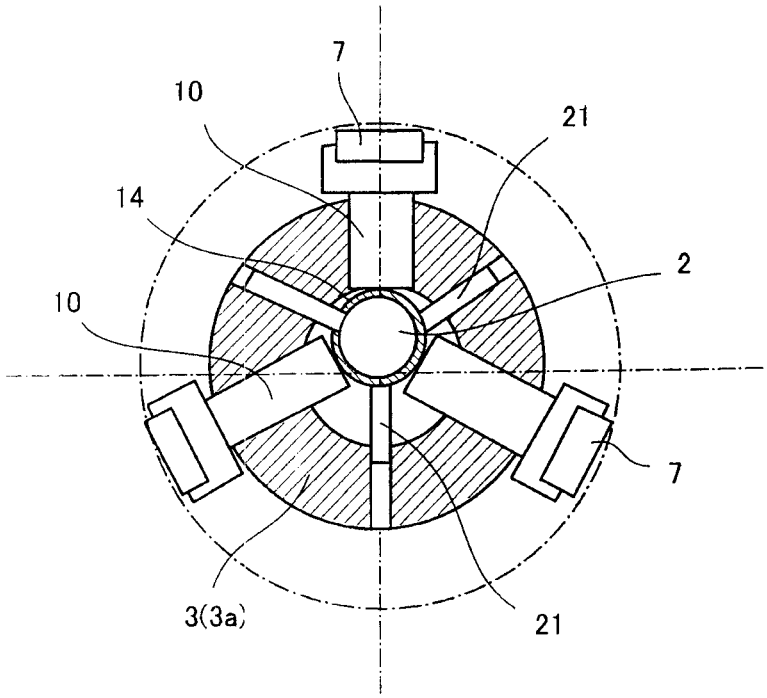
FIG. 6 is a sectional view similar to FIG. 5 showing another embodiment.
Figure 7:
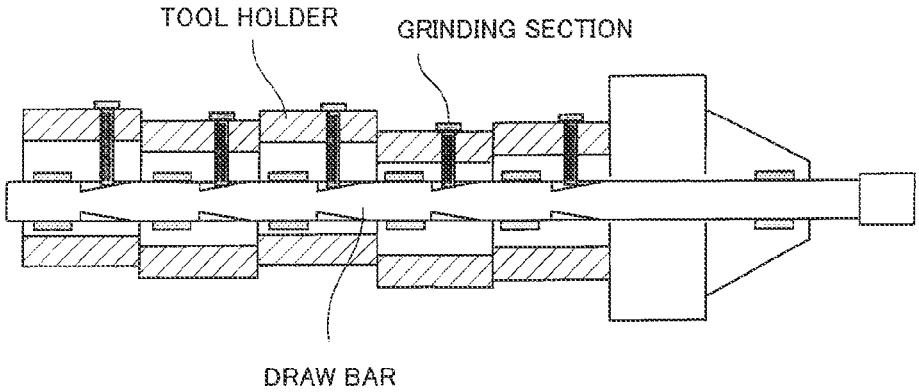
FIGS. 7(A) and 7(B) are views for explaining a problem point of a conventional tool.
Figure 7:
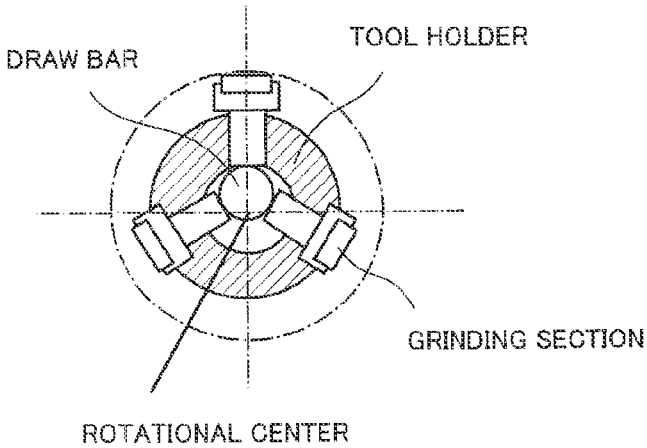

The injection of the filler 21 is only an example of fixing means. Alternatively, the support bush 14 may be also fixed to the divided tool holder 3*a* at three positions, for example, from outside by using threaded members 21 such as screws in a state in which the draw bar 2 is inserted into the divided tool holder 3*a* (the tool holder 3) as shown in FIG. 6.

Although the embodiment in which the tool holder includes the plurality of divided tool holders is shown as an example, the present invention can be also applied to a single tool holder.

The machining tool according to the present invention can be used in a field in which the inner peripheral surface of a journal bearing or the like is ground.

What is claimed is:

1. A method of assembling an inner diameter grinding tool comprising the steps of:

assembling a support bush, a draw bar, and a cylindrical tool holder together so that the support bush and the draw bar are received within the tool holder and the draw bar is received within the support bush, wherein at least a portion of an outer peripheral surface of the support bush is radially spaced from an inner peripheral surface of the tool holder so as to define a gap;

injecting a filler into the gap after the support bush has been received within the tool holder so as to fix the gap; and adjusting a projecting amount of each grinding section such that a plurality of grinding sections held circumferentially away from each other on the tool holder rotate along a same rotational trajectory and a center of the rotational trajectory corresponds to an axis of the draw bar.

2. The method of assembling an inner diameter grinding tool according to claim 1, wherein the tool holder is axially divided into a plurality of divided tool holders, and the support bush is fixed to each of the divided tool holders.

3. The method of assembling an inner diameter grinding tool according to claim 1, wherein the filler is injected into the gap through an injection port that radially extends through the tool holder.

4. A method of assembling an inner diameter grinding tool comprising the steps of:

assembling a support bush, a draw bar, and a cylindrical tool holder together so that the support bush and the draw bar are received within the tool holder and the draw bar is received within the support bush, wherein at least a portion of an outer peripheral surface of the support bush is radially spaced from an inner peripheral surface of the tool holder so as to define a gap;

threading a threaded member through the tool holder after the support bush has been received within the tool holder so as to fix the gap; and adjusting a projecting amount of each grinding section such that a plurality of grinding sections held circumferentially away from each other on the tool holder rotate along a same rotational trajectory and a center of the rotational trajectory corresponds to an axis of the draw bar.

5. The method of assembling an inner diameter grinding tool according to claim 4, wherein the threaded member is treaded through the tool holder so as to contact the outer peripheral surface of the support bush.

6. The method of assembling an inner diameter grinding tool according to claim 4, wherein the tool holder is axially divided into a plurality of divided tool holders, and the support bush is fixed to each of the divided tool holders.

* * * * *